US005366142A

United States Patent [19]

Hough

[11] Patent Number: 5,366,142

[45] Date of Patent: Nov. 22, 1994

[54] CARDBOARD BOX HAVING CORNER SEALS

[75] Inventor: Graham Hough, Lake Villa, Ill.

[73] Assignee: Field Container Co. L.P., Elkgrove Village, Ill.

[21] Appl. No.: 234,538

[22] Filed: Apr. 28, 1994

[51] Int. Cl.[5] ..... B65D 5/06

[52] U.S. Cl. ..... 229/133; 229/132

[58] Field of Search ..... 229/132, 133, 183

[56] References Cited

U.S. PATENT DOCUMENTS

| | | | |
|---|---|---|---|
| 1,723,150 | 8/1929 | Gannon et al. | 229/133 |
| 2,516,085 | 7/1950 | Williamson | 229/133 |
| 2,523,488 | 9/1950 | Williamson | 229/133 |
| 3,261,536 | 7/1966 | Bixler | 229/133 |
| 4,088,263 | 5/1978 | Michetti | 229/132 |
| 4,915,292 | 4/1990 | Ielmini | 229/132 |
| 5,042,684 | 8/1991 | West et al. | 229/133 |

FOREIGN PATENT DOCUMENTS

| | | | |
|---|---|---|---|
| 713418 | 7/1965 | Canada | 229/133 |
| 1378742 | 12/1974 | United Kingdom | 229/133 |

*Primary Examiner*—Gary E. Elkins

[57] ABSTRACT

A rectangular cardboard box made from typically a single cardboard piece comprises a rectangular, tubular body having four walls terminating in end flaps which respectively connect to the walls through fold lines. The end flaps are foldable along the fold lines to close at least one end of the tubular body. The end flaps which are adjacent to each other are separated by a corner and define a first slit extending through the cardboard and along the corner between the flaps from the outer flap ends to a position which is outwardly spaced from the fold lines of the adjacent end flaps, where the first slit terminates. A second slit is defined on the inner surfaces of the adjacent end flaps. The second slit extends outwardly only partially through the thickness of the cardboard piece and defines a line that extends outwardly from the fold line of one adjacent end flap, then extending across the corner between the end flaps, and further extending inwardly to the fold line of the other adjacent end flap. By this means, folding of the adjacent flaps causes a tearing and inward folding of a portion of the cardboard defined by the line at the box corner, to serve as a corner seal.

16 Claims, 2 Drawing Sheets

Fig. 1
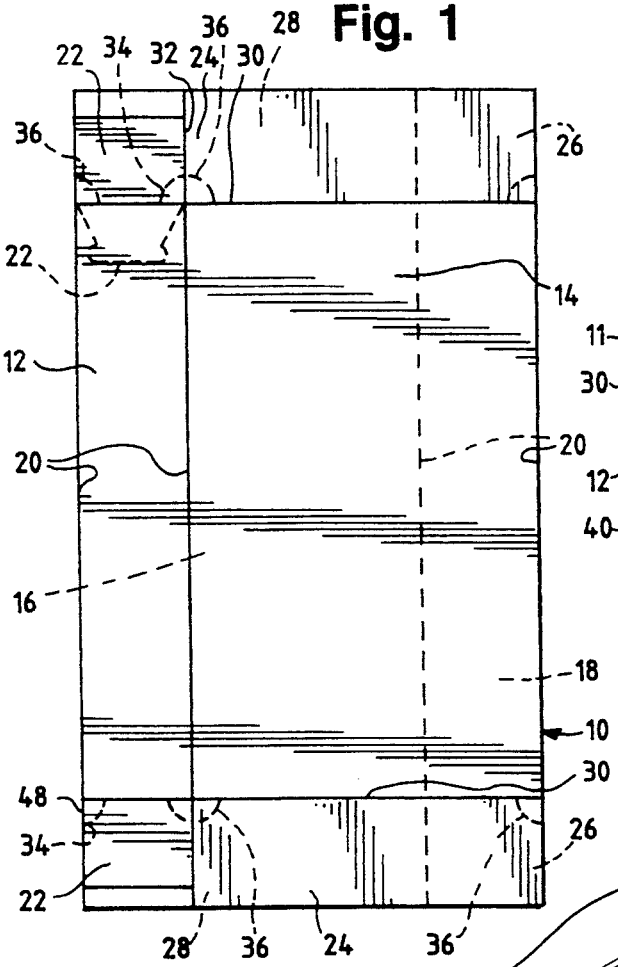
Fig. 2
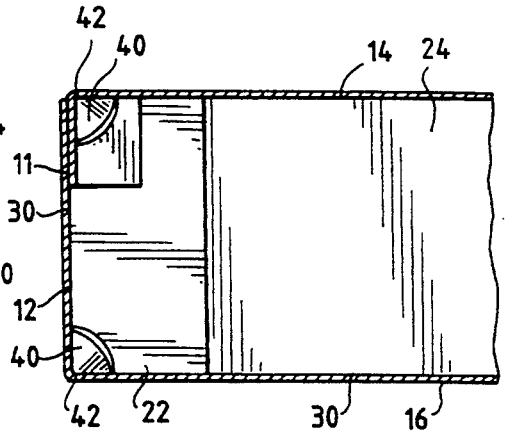
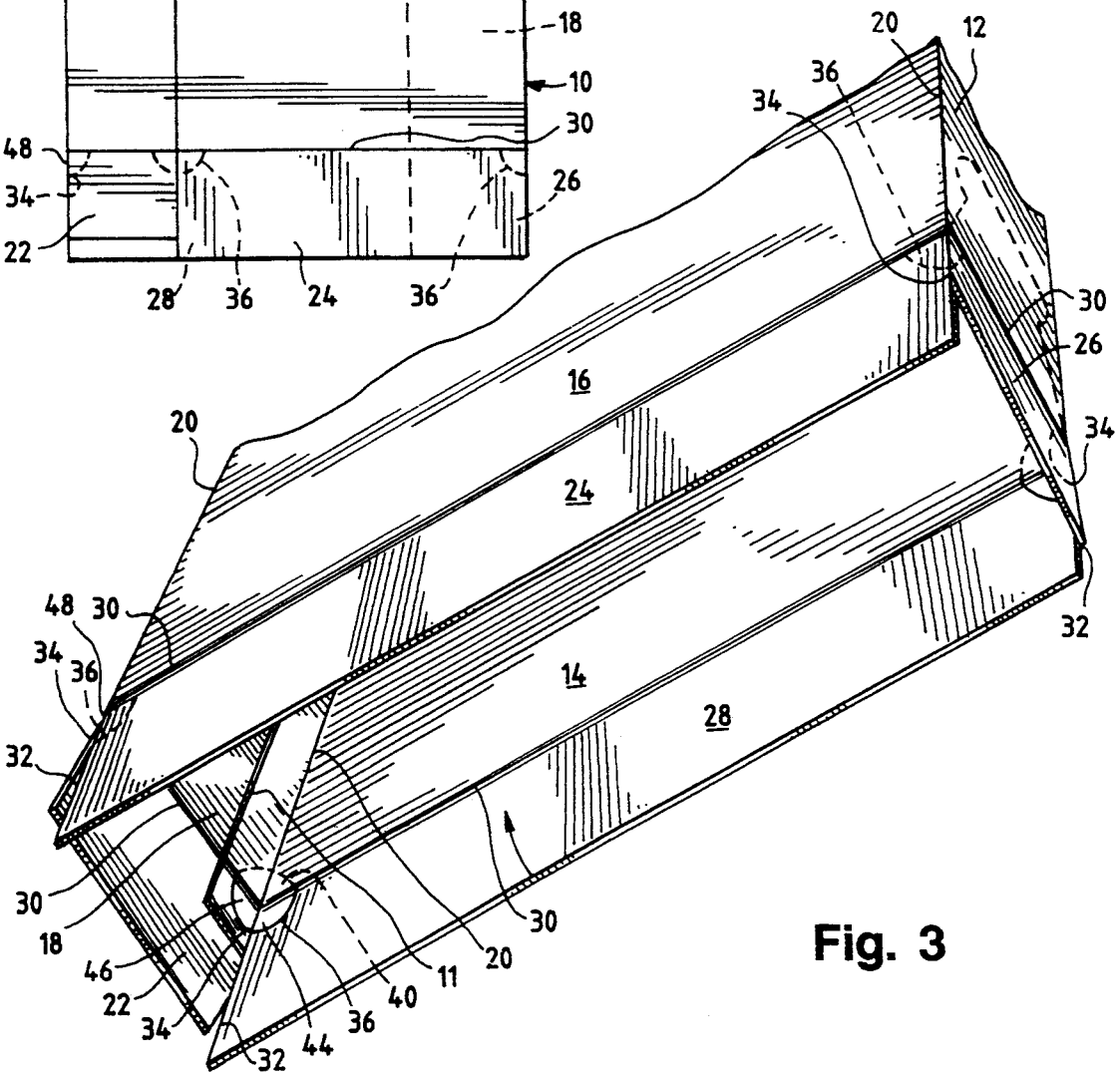
Fig. 3

CARDBOARD BOX HAVING CORNER SEALS

BACKGROUND OF THE INVENTION

Cardboard boxes which are folded from a single cardboard piece are very common, and typically comprise a flat cardboard blank, which is folded together to define a rectangular, tubular body having four walls, with each end terminating in end flaps. The end flaps respectively connect to the walls through fold lines, and are foldable along the fold lines to close the tubular body at the ends.

When the walls are folded, the adjacent end flaps meet at corners which are extensions of the corner lines of the rectangular, tubular body, with the corners of the end flaps being slit down to the fold lines. Thus, in the prior art, the respective end flaps can be folded together in the typical manner of a cereal box, for closing the container at both ends.

However, particularly in the field of cereal boxes and other foods, this common structure results in the creation of a tiny aperture adjacent each junction of the fold lines of adjacent end flaps. It has been found that, particularly in tropical climates and while camping, small insects and the like are capable of gaining entry to the container through this corner aperture at the junction between the fold lines of two flaps and a fold line between two of the walls that define the rectangular, tubular body.

By this invention, an integral corner seal can be provided to rectangular cardboard boxes that are made from a cardboard piece or blank without the addition of added parts. The seal can be provided to a wide variety of cardboard box designs without the added expense of an extra part, and only with the minimal capital expense pertaining to a modification of the machine that does the scoring of the box.

DESCRIPTION OF THE INVENTION

By this invention, a rectangular cardboard box is provided, made from a cardboard piece, and of the type described above having a rectangular, tubular body and end flaps which are foldable along fold lines to close at least one end of the tubular body. The end flaps which are adjacent to each other are separated by a corner, and a first slit extending partway along the corner between the flaps from the outer flap ends to a position which is outwardly spaced from the fold lines of the adjacent end flaps. The first slit terminates at that position.

In other words, contrary to the prior art, a complete slit does not extend all the way down the sides of the flaps to the fold line. Rather, the complete slit terminates along the flap in spaced relation from the fold line.

Further by this invention, adjacent end flaps define a second slit on their inner surfaces. The second slit extends outwardly from the inner surface of the cardboard piece only partially through the thickness thereof, so that the cardboard remains intact, and the slit does not communicate through to the outer surface of the cardboard piece. The second slit defines a line that extends outwardly from the fold line of one adjacent end flap, further extending across the corner between the adjacent end flaps, and then extending inwardly to the fold line of the other adjacent end flap. Preferably, the line defined by the second slit is arcuate, specifically being approximately of the shape of a semicircle when the cardboard piece is flat, with the ends of the semi-circle substantially communicating with the fold lines of the respective, adjacent flaps.

It is also preferable for a third slit to be defined on the outside corner of the adjacent flaps and extending only part way through the cardboard piece. The third slit originates at about the outwardly spaced position mentioned above which is the inward termination point of the first slit, extending inwardly along the corner between the adjacent flap ends to a point of substantial intersection with the flap end fold lines, preferably to the point where the two adjacent flap fold lines intersect a fold line between walls of the rectangular body.

The above configuration of second and optional third slits, which do not extend completely through the cardboard, results in the tearing of a seal portion of the cardboard which is of less thickness than the entire cardboard, and which is largely defined by the line of the second slit. As the two adjacent flaps are folded inwardly, this seal portion is torn partially loose from the rest of the cardboard, folding about the inside of the container corner where the insect access is formed, to serve as a seal against such access. The seal portion, which is formed by tearing of the cardboard in a direction substantially parallel to the plane of the cardboard, can form a fan-shaped seal, particularly when the line of the second slit is of substantially semi-circular shape, being positioned symmetrically on each of the adjacent end flaps so that the line is substantially bisected by the corner between the flaps.

The seal portion of this invention is formed simply as the box and flaps are folded together in the usual manner, to provide a container which exhibits improved resistance against small insect infestation and the like.

DESCRIPTION OF THE DRAWINGS

Referring to the drawings, FIG. 1 is a plan view of a flattened box made of a single blank and previously folded into rectangular, tubular form;

FIG. 2 is a partial, elevational view looking into the box of FIG. 1, with the walls taken in section, showing the box expanded into its rectangular, tubular form and with a closed end;

FIG. 3 is a fragmentary, perspective view showing the box of FIG. 1 formed into the rectangular tube with the end flaps still open;

DESCRIPTION OF SPECIFIC EMBODIMENTS

Figure 4:
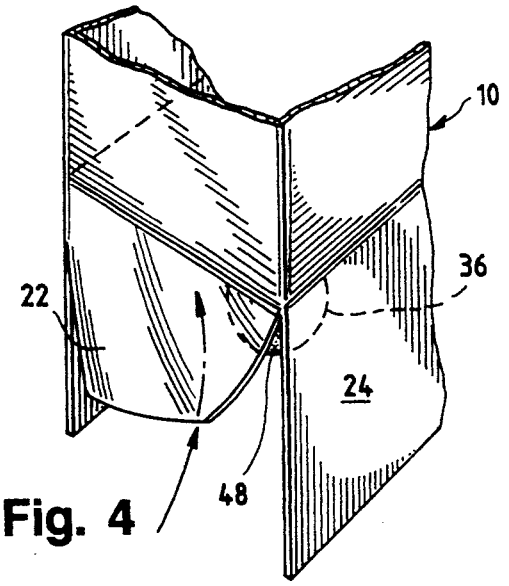
FIG. 4 is a fragmentary perspective view of a portion of the box of FIG. 1 with open end flaps.

Referring to the drawings, box 10 is shown in a flattened form in which the original, flat cardboard blank has been sealed with a typical fold-over seal 11 to form a rectangular, tubular body having four walls when moved out of the flattened condition shown in FIG. 1. Specifically, the four rectangular tubular body walls 12 and 14 are seen directly in FIG. 1, with the other two walls 16, 18 being positioned behind the first two walls. Each of the walls 12–18 are connected to each other by fold lines 20.

A tear line 22 defines a spout for the container, which is not found on any other wall except for wall 12 in this embodiment, and may be replaced with other designs of package access in other embodiments.

The respective end flaps 22, 24, 26, 28 are positioned, one of each of said flaps extending from each end of the respective tubular body walls 12, 14, 16, 18, to form the sealing end flaps. End flaps 22–28 fold together along a common rectangular fold line 30, which separates the respective end flaps from each of their respective tubular body walls.

In accordance with this invention, each of the respective adjacent end flaps 22–28 are separated by a corner which defines a first slit 32 that extends completely through the cardboard, and which extends from the outer ends of the end flaps inwardly to a position 34, where the complete slit 32 terminates. On the inside of the flap surfaces, each pair of adjacent flaps defines a second slit 36, which defines a line that does not extend completely through the thickness of the cardboard, but rather extends outwardly from the flap inner surfaces only about half way. It can be seen that second slit 36 on the inside of container 10 is shown in the specific embodiment to be substantially semi-circular when flat as in FIG. 1, extending outwardly from the fold line 30 of one adjacent end flap such as flap 22, across the corner line which is an extension of the associated lines 20 or 32, and then inwardly to the fold line 30 of the other adjacent end flap, for example flap 24. Each of these semi-circular slits are associated with a box corner, with all eight of the corners having such an associated partial slit line 36.

Thus, when the flaps at the end of box 10 are folded together to close the box end (as particularly shown in FIG. 2) flap 22 is folded inwardly. As it folds, it tears a fan-shaped portion 40 loose from the area partially inscribed by slit 36, with the tearing taking place within the cardboard in a direction which is substantially parallel to the plane of the cardboard.

The start of the folding is shown in FIG. 3, with the resulting fan-shaped member 40 being shown in phantom lines. The finish of the folding is shown in FIG. 2, where fan-shaped area 40 is still integral with flap 22, and forms a fanlike inner seal about one corner 42 of the box. As the various end flaps are folded inwardly, the respective second slits 36 all tear to fold a fanlike seal 40 in similar manner, to provide such a fan-shaped seal 40 for each of the eight corners of the box. It can be seen that most of the ripping in a planar direction relative to the cardboard takes place in area 44 (FIG. 3) inscribed by half of line 36, as end flap 22 is folded inwardly. If end flap 28 were folded prior to end flap 22, then the other fan-shaped portion 46 would be torn loose more than area 44.

As a minimum, line 36 can extend in an arc from one edge 30 just to corner 32, 34, 48 to circumscribe, for example, area 44. The desired seal is formed if the adjacent end flap 22 is folded in first and then the end flap 28 that carries the shortened line 36.

To facilitate the folding process and the formation of the fan-shaped seal 40, a third slit 48 extends from the outer surface of the cardboard, part way only through the cardboard (typically about halfway) along the corners of the flaps from position 34 (FIG. 3) to flap fold line 30. Thus, the fan-shaped piece 40 which is torn loose has its two sections 44, 46 connected to each other, which facilitates the process of forming the seal upon folding of the box end flaps.

FIG. 4 shows a fragmentary view of box 10, with end flap 22 pulled away from end flap 24 to show how third slit 48 only extends part way through the cardboard.

Figure 5:
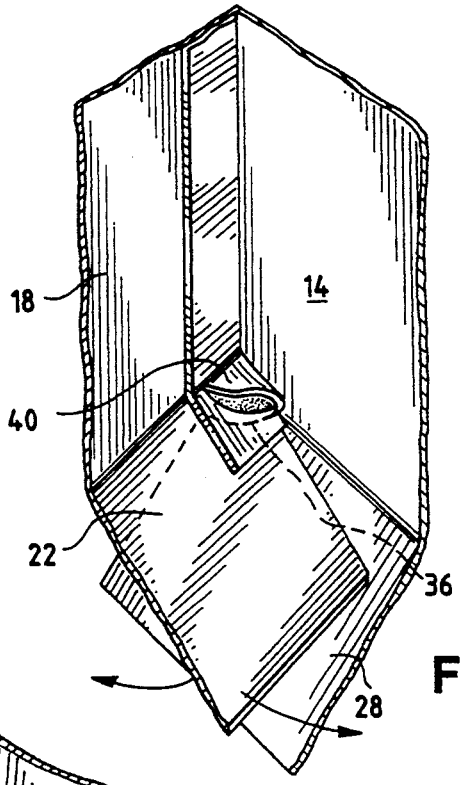
FIG. 5 is a fragmentary, perspective view taken from the interior of the box of FIG. 1 as adjacent end flaps are being closed.

FIG. 5 shows a view from the inside of box 10, and further showing how fan-shaped flap 40 can be formed as the respective end flaps 22, 28, for example, are folded inwardly.

Figure 6:
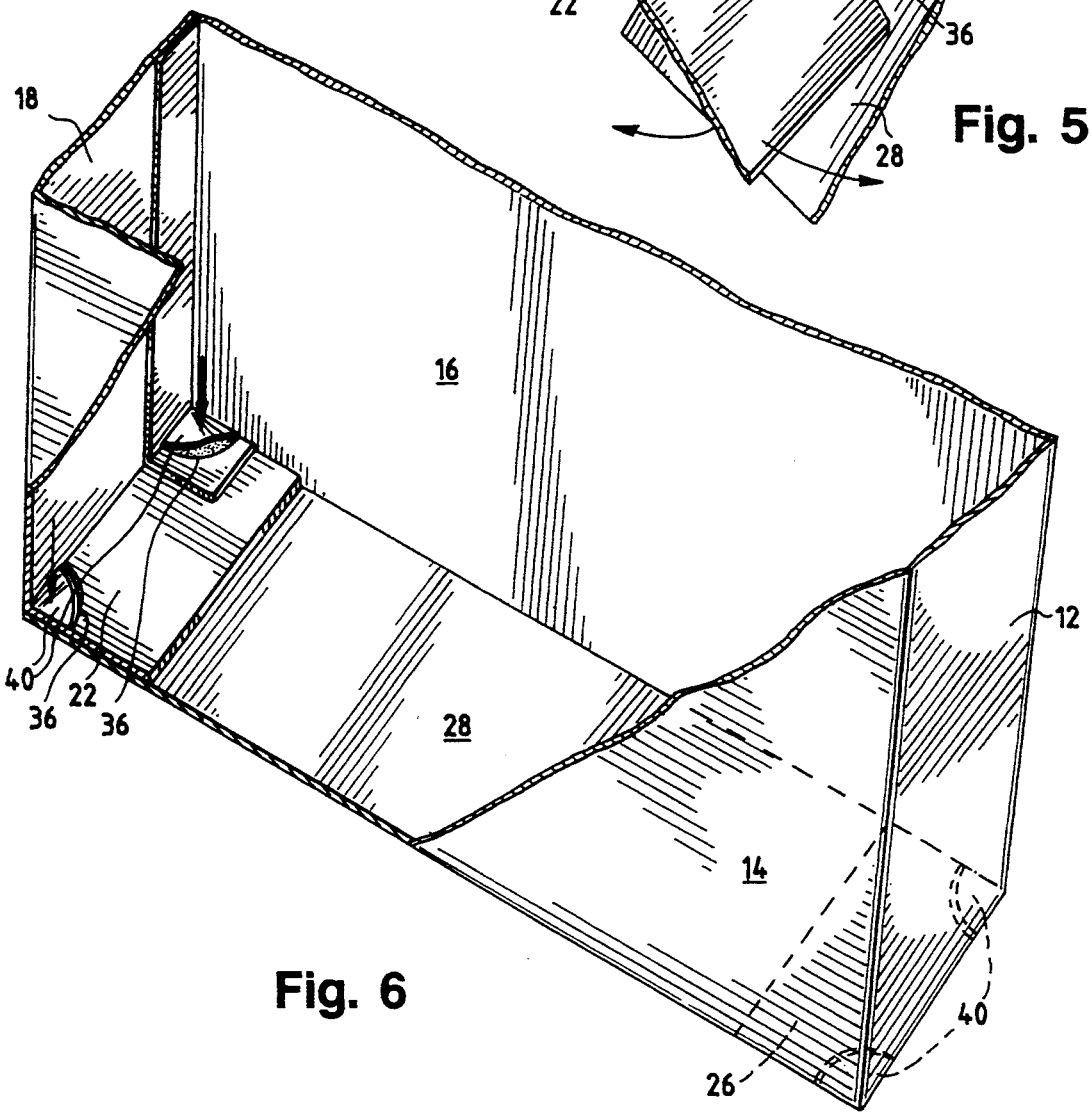
FIG. 6 is a fragmentary, perspective view, with portions broken away, showing the box of FIG. 1 with closed end flaps.

FIG. 6 shows a folded box end with the desired fan-shaped sealing flaps 40 which have been formed by the folding action as described above.

Thus, by this invention, a seal for the corners of folded cardboard boxes is provided, without the need for the addition of added parts to the single cardboard blank which typically forms the box. This seal, as described, provides further protection to food containers such as cereal boxes, further reducing the opportunities for insect access and infestation. The seal is deployed by the simple act of folding of the ends of the box in the usual manufacturing manner.

The above is offered for illustrative purposes only, and is not intended to limit the scope of the invention of this application, which is as defined in the claims below.

That which is claimed is:

1. A rectangular cardboard box made from a cardboard piece, which comprises a rectangular, tubular body having four walls terminating in end flaps which respectively connect to said walls through fold lines, said end flaps being foldable along said fold lines to close at least one end of said tubular body; said end flaps which are adjacent to each other being separated by a corner and defining a first slit through the cardboard piece, said first slit extending partway along said corner between said flaps from the outer flap ends to a position which is outwardly spaced from said fold lines of said adjacent flaps and terminating there; said adjacent end flaps defining a second slit on the inner surfaces of said adjacent end flaps, said second slit extending outwardly only partially through the thickness of said cardboard piece and defining a line that extends outwardly from the fold line of one adjacent end flap, across said corner, and inwardly to the fold line of the other adjacent end flap, whereby folding of said adjacent flaps causes a tearing and inward folding of a portion of said cardboard defined by said line to serve as a corner seal.

2. The cardboard box of claim 1 in which a third slit extends partway through said cardboard piece from said outwardly spaced position along the corner between said adjacent flap ends to a point of substantial intersection with the fold lines of said adjacent flap ends.

3. The cardboard box of claim 2 in which said outwardly spaced position substantially occupies a point on the line of said second slit.

4. The cardboard box of claim 1 in which said line is of substantially the shape of a semi-circle.

5. The cardboard box of claim 1 in which all adjacent end flaps present carry said second slits.

6. The cardboard box of claim 5 in which both ends of said box carry said end flaps.

7. The cardboard box of claim 1 in which said outwardly spaced position substantially intersects the line of said second slit.

8. A rectangular cardboard box made from a single cardboard piece, which comprises a rectangular tubular body having four walls terminating in end flaps which respectively connect said walls through fold lines, said end flaps being foldable along said fold lines to close at least one end of said tubular body; said end flaps which are adjacent to each other being separated by a corner and defining a first slit through the cardboard piece, said first slit extending partway along said corner between said flaps from the outer end flaps to a position which is outwardly spaced from said fold lines of said adjacent flaps and terminating there; said adjacent end flaps defining a second slit on the inner surfaces of said adjacent end flaps, said second slit extending outwardly only partially through the thickness of said cardboard piece and defining a line that is of substantially the shape of a semi-circle, said line extending outwardly from the fold line of one adjacent end flap, across said corner, and inwardly to the fold line of the other adjacent end flap; and a third slit extending partway through said cardboard piece from said outwardly spaced position along the corner between said adjacent end flaps to a point of substantial intersection with the fold lines of said adjacent end flaps, whereby folding of said adjacent flaps causes a tearing and inward folding of an arc-shaped portion of said cardboard defined by said line to serve as a corner seal.

9. The cardboard box of claim 8 in which all adjacent end flaps present carry said second slits.

10. The cardboard box of claim 9 in which both ends of said box carry said end flaps.

11. The cardboard box of claim 10 in which said outwardly spaced position substantially intersects the line of said second slit.

12. A cardboard container made from a cardboard piece which comprises a tubular body having walls separated by first fold lines, said tubular body terminating in end flaps which respectively connect to the walls through second fold lines; the end flaps being foldable along said second fold lines to close at least one end of the tubular body; the end flaps which are adjacent to each other being separated by a corner, and defining a first slit extending partway along the corner between said flaps from the outer end flaps to a position which is outwardly spaced from said second fold lines of the adjacent end flaps, said first slit terminating at said position; the adjacent end flaps defining a second slit on the inner surfaces of said adjacent end flaps, said second slit extending outwardly only partially through the thickness of said cardboard piece and defining a line that extends outwardly from the second fold line of one adjacent end flap, to said corner, and optionally from the corner inwardly to the second fold line of the other adjacent end flap, whereby folding of said other adjacent end flap prior to said one adjacent end flap causes a tearing and inward folding of a portion of said cardboard defined by said line to serve as a corner seal.

13. The cardboard box of claim 12 in which a third slit extends partway through said cardboard piece from the outwardly spaced position along the corner between said adjacent end flaps, to a point of substantial intersection with the second fold lines of said adjacent end flaps.

14. The cardboard box of claim 12 in which said outwardly spaced position substantially intersects the line of said second slit.

15. The cardboard box of claim 12 in which said second slit extends across said corner and inwardly to the second fold line of the other, adjacent end flap.

16. The cardboard box of claim 12 in which said second fold line is arc shaped.

* * * * *